US007804466B2

(12) United States Patent
Kwak et al.

(10) Patent No.: US 7,804,466 B2
(45) Date of Patent: Sep. 28, 2010

(54) DISPLAY DEVICE AND DRIVING METHOD THEREOF

(75) Inventors: Won-Kyu Kwak, Suwon-si (KR); Byung-Hee Kim, Suwon-si (KR)

(73) Assignee: Samsung Mobile Display Co., Ltd., Yongin-si (KR)

( * ) Notice: Subject to any disclaimer, the term of this patent is extended or adjusted under 35 U.S.C. 154(b) by 728 days.

(21) Appl. No.: 11/055,400

(22) Filed: Feb. 10, 2005

(65) Prior Publication Data

US 2005/0200617 A1 Sep. 15, 2005

(30) Foreign Application Priority Data

Mar. 15, 2004 (KR) ..... 10-2004-0017309

(51) Int. Cl.
*G09G 3/32* (2006.01)

(52) U.S. Cl. ..... 345/76; 345/88; 345/87

(58) Field of Classification Search ..... 345/76; 315/169

See application file for complete search history.

(56) References Cited

U.S. PATENT DOCUMENTS

| | | | | |
|---|---|---|---|---|
| 5,748,160 | A | 5/1998 | Shieh et al. | |
| 6,184,853 | B1 * | 2/2001 | Hebiguchi et al. | 345/88 |
| 6,421,033 | B1 | 7/2002 | Williams et al. | |
| 6,583,775 | B1 * | 6/2003 | Sekiya et al. | 345/76 |
| 6,618,031 | B1 * | 9/2003 | Bohn et al. | 345/83 |
| 7,227,517 | B2 * | 6/2007 | Imamura | 345/76 |
| 2002/0043941 | A1 | 4/2002 | Iketsu et al. | |
| 2003/0214493 | A1 * | 11/2003 | Akimoto et al. | 345/204 |
| 2005/0017934 | A1 | 1/2005 | Chung et al. | |
| 2005/0110723 | A1 | 5/2005 | Shin | |
| 2006/0097966 | A1 | 5/2006 | Choi | |
| 2006/0103611 | A1 | 5/2006 | Choi | |
| 2007/0138947 | A1 | 6/2007 | Popovic et al. | |

FOREIGN PATENT DOCUMENTS

| | | | |
|---|---|---|---|
| CN | 1577453 | A | 2/2005 |
| CN | 1622723 | A | 6/2005 |
| EP | 0 762 374 | A1 | 3/1997 |

(Continued)

OTHER PUBLICATIONS

Patent Abstracts of Japan, Publication No. 10-333639, dated Dec. 18, 1998, in the name of Junpei Hashiguchi.

(Continued)

*Primary Examiner*—Alexander Eisen
*Assistant Examiner*—Stuart McCommas
(74) *Attorney, Agent, or Firm*—Christie, Parker & Hale, LLP

(57) ABSTRACT

Red, green, and blue organic electroluminescent (EL) elements formed on a pixel in an organic EL display are driven by a driving transistor. A capacitor is coupled between a gate and a source of the driving transistor to maintain a voltage for a predetermined time. Emission control transistors are coupled between the driving transistor and the red, green, and blue organic EL elements, respectively. One field is divided into three subfields, and one of the red, green and blue organic EL elements in each pixel starts to emit light in each subfield to thus represent a full color screen. The red, green and blue organic elements sequentially start to emit light in each subfield such that a color separation phenomenon caused by start emitting organic EL elements of one color during each subfield is reduced or eliminated.

25 Claims, 9 Drawing Sheets

FOREIGN PATENT DOCUMENTS

| | | |
|---|---|---|
| JP | 02-073292 | 3/1990 |
| JP | 06-124069 | 5/1994 |
| JP | 9-138659 | 5/1997 |
| JP | 10-333639 | 12/1998 |
| JP | 2002-72980 | 3/2002 |
| JP | 2002-149129 | 5/2002 |
| JP | 2002-297083 | 10/2002 |
| JP | 2003-510661 | 3/2003 |
| JP | 2003-122306 | 4/2003 |
| JP | 2005-148749 | 6/2005 |
| JP | 2005-148750 | 6/2005 |
| JP | 2005-148751 | 6/2005 |
| JP | 2005-157258 | 6/2005 |
| JP | 2005-157267 | 6/2005 |
| WO | WO 01/24153 | 4/2001 |

OTHER PUBLICATIONS

Patent Abstracts of Japan, Publication No. 09-138659, dated May 27, 1997, in the name of Chan-Long Shieh et al.

Patent Abstracts of Japan, Publication No. 2002-072980, dated Mar. 12, 2002, in the name of Masao Imai.

Patent Abstracts of Japan, Publication No. 2003-122306, dated Apr. 25, 2003, in the name of Akira Yumoto.

Patent Abstracts of Japan, Publication No. 2002149129, dated May 24, 2002, in the name of Atsushi Yamanaka.

Patent Abstracts of Japan, Publication No. 2002-297083, dated Oct. 9, 2002, in the name of Hideto Kitakado et al.

SIPO Office action dated May 9, 2008 for corresponding Chinese Patent Application No. 200610143369.3, with English translation indicating relevance of the listed references in this IDS.

U.S. Office action dated Jul. 6, 2009, for related U.S. Appl. No. 11/519,730, noting listed U.S. Publications in this IDS.

U.S. Office action dated Aug. 11, 2009, for related U.S. Appl. No. 11/055,441, noting listed U.S. Patent in this IDS.

* cited by examiner

DISPLAY DEVICE AND DRIVING METHOD THEREOF

CROSS REFERENCE TO RELATED APPLICATION

This application claims priority to and the benefit of Korea Patent Application No. 10-2004-0017309 filed on Mar. 15, 2004 in the Korean Intellectual Property Office, the entire content of which is incorporated herein by reference.

BACKGROUND OF THE INVENTION (a) Field of the Invention

The present invention relates to a display device and a driving method thereof. More specifically, the present invention relates to an organic electroluminescent (EL) display using electroluminescence of organic matter, and a driving method thereof.

(b) Description of the Related Art

In general, an organic EL display is a display device for electrically exciting phosphorous organic compounds and emitting light. The organic EL display drives organic light emission cells arranged in a matrix format to represent images. An organic light emission cell having a diode characteristic is referred to as an organic light emission diode (OLED) and has a structure including an anode electrode layer, an organic thin film, and a cathode electrode layer. Holes and electrons injected through the anode electrode and the cathode electrode are combined on the organic thin film, and emit light. The organic light emission cell emits different amounts of light according to injected amounts of electrons and holes, that is, depending on the applied current.

In the organic EL display, a pixel includes a plurality of sub-pixels each of which has one of a plurality of colors (e.g., primary colors of light), and colors are represented through combinations of the colors emitted by the sub-pixels. In general, a pixel includes a sub-pixel for displaying red R, a sub-pixel for displaying green G, and a sub-pixel for displaying blue B, and the colors are displayed by combinations of red, green, and blue (RGB).

Each sub-pixel in the organic EL display includes a driving transistor for driving an organic EL element, a switching transistor, and a capacitor. Also, each sub-pixel has a data line for transmitting a data signal, and a power line for transmitting a power supply voltage VDD. Therefore, many wires are required for transmitting voltages or signals to the transistors and capacitor formed at each pixel. It is difficult to arrange such wires in the pixel, and the aperture ratio corresponding to a light emission area of the pixel is reduced.

SUMMARY OF THE INVENTION

In an exemplary embodiment of the present invention, is provided a display device in which the aperture ratio is improved.

In another exemplary embodiment of the present invention, is provided a display device for simplifying configurations and wiring of elements in the pixel.

In another exemplary embodiment of the present invention, a plurality of light emission elements in one pixel share a driver.

In one aspect of the present invention, is provided a display device including a plurality of rows of pixels for displaying an image during a field having a plurality of subfields, each of the pixels comprising a plurality of light emitting elements having different colors. A plurality of data lines apply data signals to the pixels for the light emitting elements to emit light, and a plurality of select lines coupled to the pixels apply a plurality of select signals to the pixels. Each of the select lines is coupled to a corresponding one of the rows of pixels to apply a corresponding one of the select signals thereto, wherein the select signals sequentially select the rows of pixels during each of the plurality of subfields. The data signals are applied to the pixels for the light emitting elements having different colors to sequentially start emitting different color lights during each of the plurality of subfields.

In one aspect of the present invention, is provided a display device including a plurality of scan lines, a plurality of data lines, and a plurality of pixel circuits. The scan lines include a first scan line for applying a first signal and a second scan line for applying a second signal at a time different from that of applying the first signal. The data lines apply a data signal for displaying an image during a field having a plurality of subfields. The pixel circuits include a first pixel circuit coupled to the first scan line and one of the data lines and a second pixel circuit coupled to the second scan line and one of the data lines. Each of the pixel circuits includes: at least two emit elements, a switching transistor, a capacitor, and a driving transistor. The emit elements emit light having different colors, wherein each of the emit elements emits light responsive to an applied current. The switching transistor applies the data signal in response to the first signal or the second signal at least once for each of the subfields. The capacitor stores a voltage which corresponds to the data signal applied by the switching transistor. The driving transistor outputs an applied current which corresponds to the voltage stored in the capacitor. One of the emit elements having a color different from a first color starts emitting light in the second pixel circuit after one of the emit elements having the first color starts emitting light in the first pixel circuit in a first one of the subfields, and one of the emit elements having a color different from a second color starts emitting light in the second pixel circuit after one of the emit elements having the second color starts emitting light in the first pixel circuit in a second one of the subfields.

Each of the pixel circuits may further include at least two emitting transistors coupled between the driving transistor and the at least two emit elements, and one of the emit elements having one color from among the two emit elements emits light according to an operation of the emitting transistors.

The emit elements may include an emit element of the first color, an emit element of the second color, and an emit element of a third color. Each of the pixel circuits may further include a first emitting transistor coupled between the driving transistor and the emit element of the first color, a second emitting transistor coupled between the driving transistor and the emit element of the second color, and a third emitting transistor coupled between the driving transistor and the emit element of the third color.

The emit element of the second color of the second pixel circuit may start emitting light in the first one of the subfields, and the emit element of the third color of the second pixel circuit may start emitting light in the second one of the subfields.

A third scan line among the scan lines may apply a third signal at a timing which is different from timing of applying the first and second signals. The third pixel circuit having an emit element of the first color, an emit element of the second color and an emit element of the third color may be coupled to the third scan line and one of the data lines. The emit elements of the third color, the first color, and the second color of the third pixel circuit may start emitting light in the first subfield, the second subfield, and the third subfield, respectively.

One of the emit elements may emit light for a period which is shorter than or equal to a period which corresponds to a corresponding one of the subfields after the one of the emit elements starts emitting light.

The emit elements may emit light at least once during one field. The emit elements of the same color may emit light during a predetermined period in a plurality of pixel circuits coupled to the same one of the scan lines.

In another aspect of the present invention, is provided a display device including a plurality of scan lines for applying select signals, a plurality of data lines for applying data signals for displaying an image during a field having a plurality of subfields, and a plurality of pixel circuits coupled to the scan lines and data lines. Each of the pixel circuits includes: at least two emit elements, a switching transistor, a capacitor, a driving transistor, and a switch. The emit elements emit light having different colors, wherein each of the emit elements emits light responsive to an applied current. The switching transistor applies one of the data signals which corresponds to one of the emit elements in response to one of the select signals at least once for each of the subfields. The capacitor stores a voltage which corresponds to the one of the data signals applied by the switching transistor. The driving transistor outputs the applied current which corresponds to the voltage stored in the capacitor. The switch selectively outputs the applied current provided by the driving transistor to one of the emit elements of a color corresponding to the one of the data signals. One of the data signals corresponding to one of the emit elements of a first color is applied to one of the data lines when one of the select signals is applied to a scan line of a first group including at least one of the scan lines, and one of the data signals corresponding to one of the emit elements of a second color is applied to the one of the data lines when one of the select signals is applied to a scan line of a second group including at least one of the scan lines in a first one of the subfields.

In still another aspect of the present invention, is provided a method of driving during a field having a plurality of subfields in a display device including a plurality of pixel circuits arranged in rows, wherein each of the pixel circuits includes at least two emit elements for emitting light of different colors responsive to an applied current, and a transistor coupled to the emit elements supplies the applied current to one of the emit elements through at least one switch. The method includes: start emitting one of the emit elements of a first color on one of the pixel circuits provided on a row of a first group including at least one of the rows during a first one of the subfields, and start emitting one of the emit elements of a second color in one of the pixel circuits provided on a row of a second group including at least one of the rows during the first one of the subfields.

The method may further include: start emitting one of the emit elements of a color different from the first color in one of the pixel circuits provided on a row of the first group during a second one of the subfields, and start emitting one of the emit elements of a color different from the second color in one of the pixel circuits provided on a row of the second group during the second one of the subfields.

In the method, one of the emit elements of a third color may start emitting in one of the pixel circuits provided on a row of a third group including at least one of the rows during the first one of the subfields, and one of the emit elements of a color different from the third color in one of the pixel circuits provided on a row of the third group may start emitting during the second one of the subfields.

In the method, one of the emit elements of the third color in one of the pixel circuits provided on a row of the first group may start emitting during a third one of the subfields, one of the emit elements of the first color in one of the pixel circuits provided on a row of the second group may start emitting during the third one of the subfields, and one of the emit elements of the second color in one of the pixel circuits provided on a row of the third group may start emitting during the third one of the subfields.

BRIEF DESCRIPTION OF THE DRAWINGS

The accompanying drawings illustrate exemplary embodiments of the present invention, and, together with the description, serve to explain the principles of the invention.

DETAILED DESCRIPTION

Figure 1:
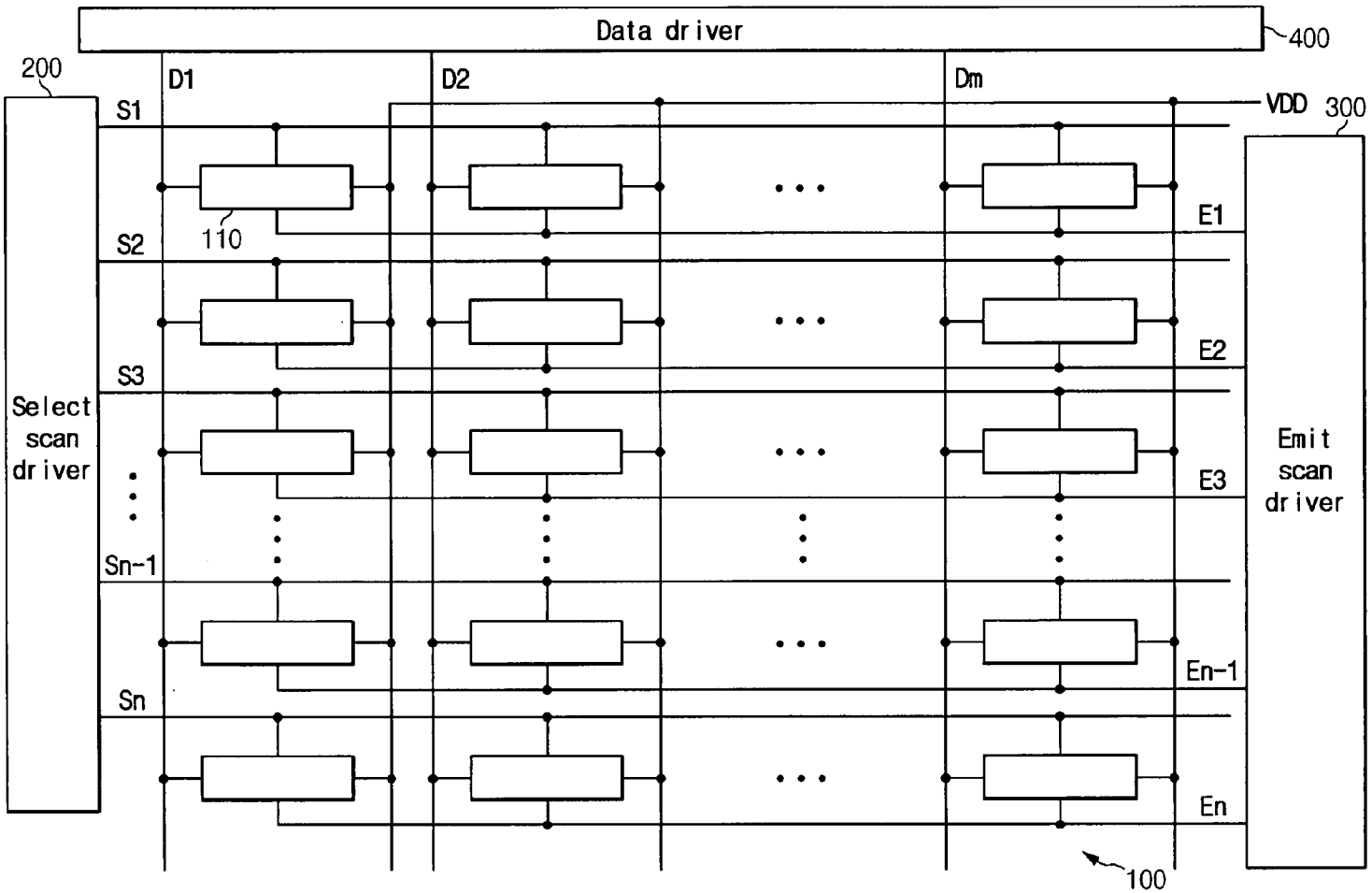
FIG. 1 shows a plan view of an organic EL display used to implement exemplary embodiments of the present invention.

In the following detailed description, only certain exemplary embodiments of the present invention are shown and described, simply by way of illustration. As those skilled in the art would realize, the described embodiments may be modified in various different ways, all without departing from the spirit or scope of the present invention. Accordingly, the drawings and description are to be regarded as illustrative in nature, and not restrictive. There may be parts shown in the drawings, or parts not shown in the drawings, that are not discussed in the specification as they are not essential to a complete understanding of the invention. Like reference numerals designate like elements.

A light emission display and driving method according to exemplary embodiments of the present invention will be described in detail with reference to drawings, and an organic EL display will be exemplified and described in the exemplary embodiments.

Figure 2:
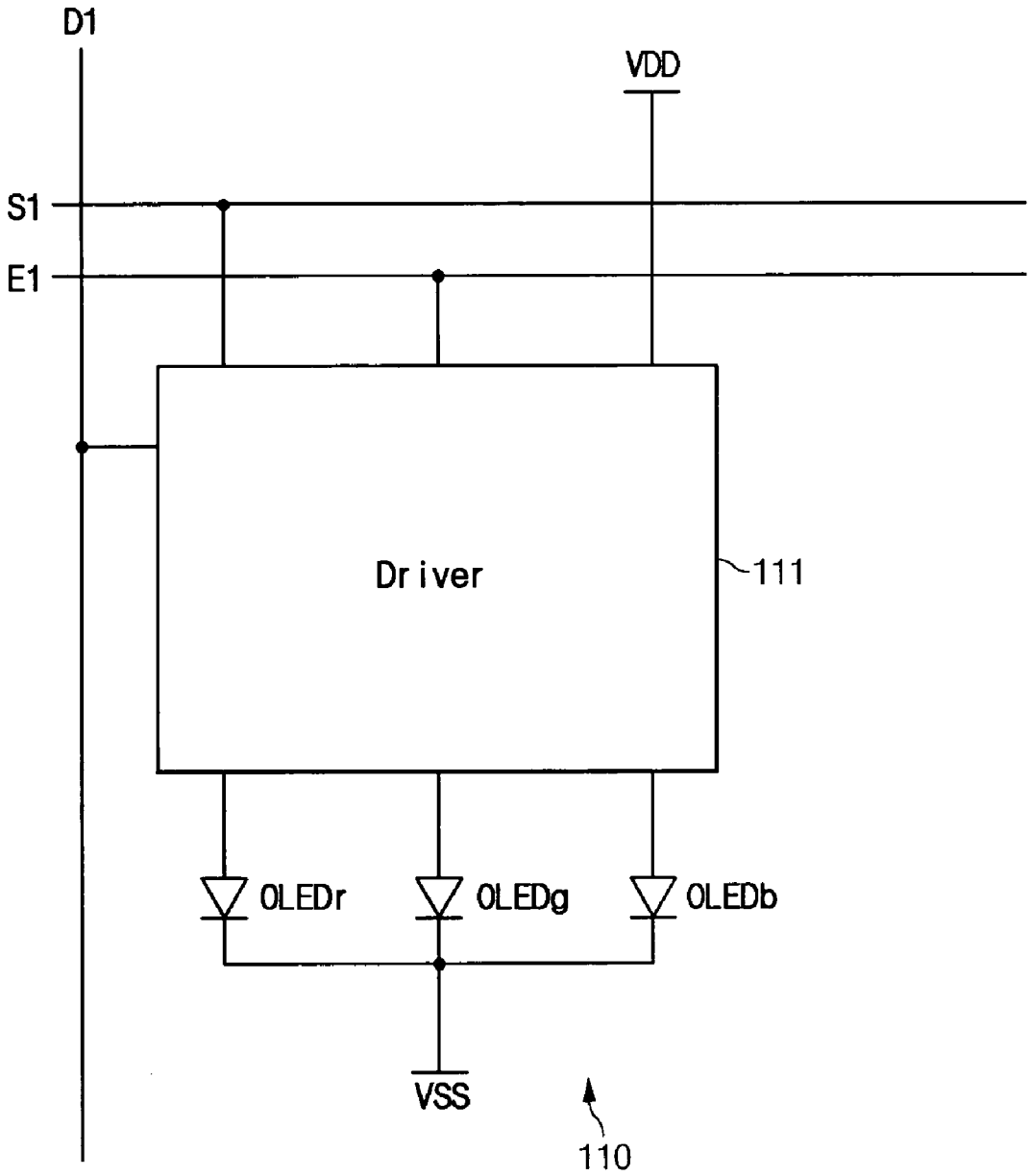
FIG. 2 shows a conceptual diagram of a pixel in the organic EL display of FIG. 1.

FIG. 1 shows a plan view of an organic EL display used to implement exemplary embodiments of the present invention, and FIG. 2 shows a conceptual diagram of a pixel in the organic EL display of FIG. 1.

As shown in FIG. 1, the organic EL display includes a display 100, a select scan driver 200, an emit scan driver 300, and a data driver 400. The display 100 includes a plurality of scan lines S1 to Sn and E1 to En arranged in the row direction, and a plurality of data lines D1 to Dm, a plurality of power lines VDD, and a plurality of pixels 110 respectively arranged in the column direction. The pixels are formed at pixel areas formed by two adjacent ones of the scan lines S1 to Sn and two adjacent ones of the data lines D1 to Dm. Referring to FIG. 2, the pixel 110 includes organic EL elements OLEDr, OLEDg, and OLEDb for emitting red, green, and blue lights, respectively, and a driver 111 on which elements for driving the organic EL elements OLEDr, OLEDg, and OLEDb are formed. The organic EL elements emit light having brightness corresponding to the applied current.

The select scan driver 200 sequentially transmits select signals for selecting corresponding lines to the select scan lines S1 to Sn in order to apply data signals to pixels of the corresponding lines, the emit scan driver 300 sequentially transmits emit signals for controlling light emission of the organic EL elements OLEDr, OLEDg, and OLEDb to the emit scan lines E1 to En, and the data driver 400 applies data signals corresponding to the pixels of lines to which select signals are applied to the data lines D1 to Dm each time the select signals are sequentially applied.

The select and emit scan drivers 200 and 300 and the data driver 400 are coupled to a substrate on which the display 100 is formed. In addition, the select and emit scan drivers 200 and 300 and/or the data driver 400 can be installed directly on the substrate of the display 100, and they can be substituted with a driving circuit which is formed on the same layer on the substrate of the display 100 as the layer on which scan lines, data lines, and transistors are formed. Further, the select and emit scan drivers 200 and 300 and/or the data driver 400 can be installed in a chip format on a tape carrier package (TCP), a flexible printed circuit (FPC), or a tape automatic bonding unit (TAB) coupled to the select and emit scan drivers 200 and 300 and/or the data driver 400.

One field is divided into three subfields and then driven, and red, green, and blue data are written on the three subfields to emit light in the first exemplary embodiment. For this purpose, the select scan driver 200 sequentially transmits select signals to the select scan lines S1 to Sn for each subfield, the emit scan driver 300 applies emit signals to the emit scan lines E1 to En so that the organic EL element for each color may emit light in a subfield, and the data driver 400 applies data signals respectively corresponding to the red, green, and blue organic EL elements to the data lines D1 to Dm.

A detailed operation of the organic EL display according to a first exemplary embodiment will be described with reference to FIGS. 3 and 4.

Figure 3:
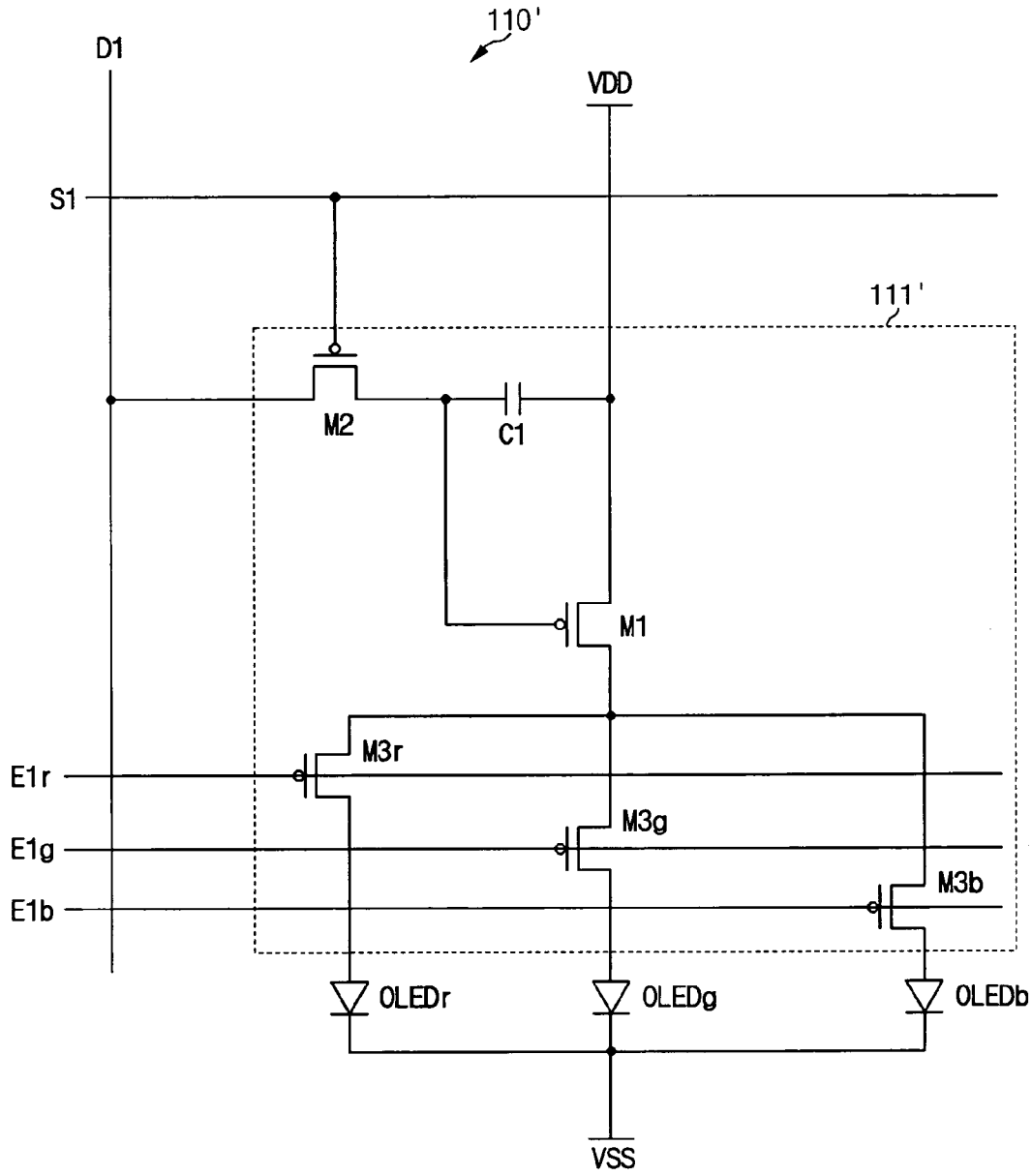
FIG. 3 shows a circuit diagram of a pixel in an organic EL display according to a first exemplary embodiment of the present invention.
Figure 4:
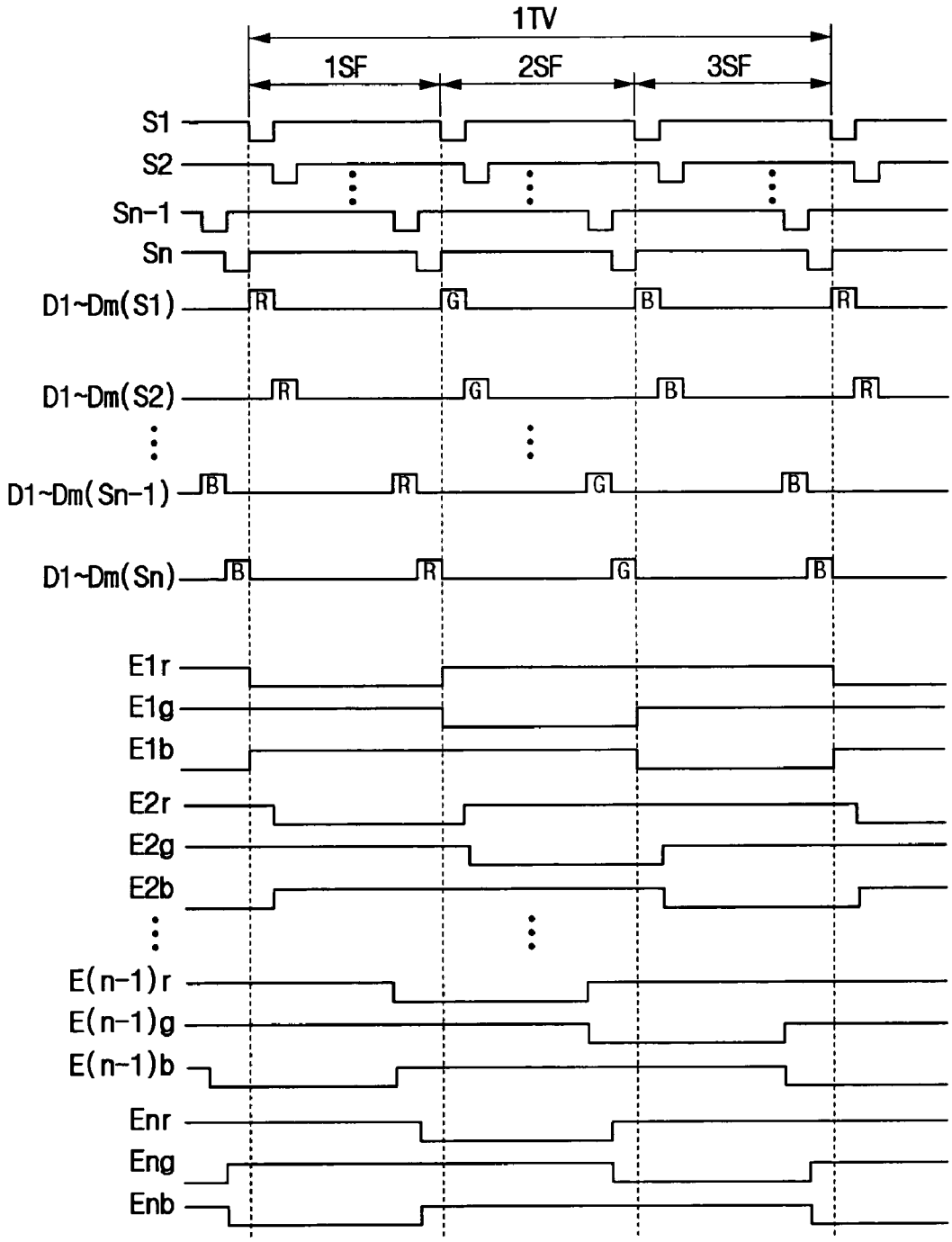
FIG. 4 shows a signal timing diagram of an organic EL display according to the first exemplary embodiment of the present invention.

FIG. 3 shows a circuit diagram of a pixel 110' in the organic EL display according to the first exemplary embodiment of the present invention, and FIG. 4 shows a signal timing diagram of the organic EL display according to the first exemplary embodiment of the present invention. The pixel 110', for example, can be used as the pixel 110 of FIGS. 1 and 2. In detail, FIG. 3 shows a voltage programmed pixel coupled to the select scan line S1 of the first row and the data line D1 of the first column. The pixel 110' includes p-channel transistors. No other pixels will be described in reference to the first exemplary embodiment since the pixels of first exemplary embodiment have substantially the same structure as that shown in FIG. 3.

As shown in FIG. 3, the pixel circuit 110' according to the first exemplary embodiment includes a driver 111' and organic EL elements OLEDr, OLEDg, and OLEDb. The driver 111' includes a driving transistor M1, a switching transistor M2, and emitting transistors M3*r*, M3*g*, and M3*b* for controlling light emission of the organic EL elements OLEDr, OLEDg, and OLEDb. One emit scan line E1 includes three emit signal lines E1*r*, E1*g*, and E1*b*, and while not illustrated in FIG. 3, other emit scan lines E2 to En respectively include three emit signal lines E2*r* to Enr, E2*g* to Eng, and E2*b* to Enb. The emitting transistors M3*r*, M3*b*, and M3*b* and the emit signal lines E1*r*, E1*g*, and E1*b* form a switch for selectively transmitting the current provided by the driving transistor M1 to the organic EL elements OLEDr, OLEDg, and OLEDb.

In detail, the switching transistor M2 having a gate coupled to the select scan line S1 and a source coupled to the data line D1 transmits the data voltage provided by the data line D1 in response to the select signal provided by the select scan line S1. The driving transistor has a source coupled to the power line VDD for supplying a power supply voltage, and has a gate coupled to a drain of the switching transistor M2, and a capacitor C1 is coupled between a source and a gate of the driving transistor M1. The driving transistor M1 has a drain coupled to sources of the emit transistors M3*r*, M3*g*, and M3*b*, and gates of the emit transistors M3*r*, M3*g*, and M3*b* are coupled to the emit signal lines E1*r*, E1*g*, and E1*b*, respectively. Drains of the emit transistors M3*r*, M3*g*, and M3*b* are coupled, respectively, to anodes of the organic EL elements OLEDr, OLEDg, and OLEDb, and a power supply voltage VSS is applied to cathodes of the organic EL elements OLEDr, OLEDg, and OLEDb. The power supply voltage VSS in the first exemplary embodiment can be a negative voltage or a ground voltage.

The switching transistor M2 transmits the data voltage provided by the data line D1 to the gate of the driving transistor M1 in response to a low-level select signal provided by the select scan line S1, and the voltage which corresponds to a difference between the data voltage transmitted to the gate of the transistor M1 and the power supply voltage VDD is stored in the capacitor C1. When the emitting transistor M3*r* is turned on in response to a low-level emit signal provided by the emit signal line E1*r*, the current which corresponds to the voltage stored in the capacitor C1 is transmitted to the red organic EL element OLEDr from the driving transistor M1 to emit light. In a like manner, when the emitting transistor M3*g* is turned on in response to a low-level emit signal provided by the emit signal line E1*g*, the current which corresponds to the voltage stored in the capacitor C1 is transmitted to the green organic EL element OLEDg from the driving transistor M1 to emit light. Further, when the emitting transistor M3*b* is turned on in response to a low-level emit signal provided by the emit signal line E1*b*, the current which corresponds to the voltage stored in the capacitor C1 is transmitted to the blue organic EL element OLEDb from the driving transistor M1 to emit light. Three emit signals applied to the three emit signal lines respectively have low-level periods without repetition during one field so that one pixel can display red, green, and blue.

An organic EL display driving method will be described in detail with reference to FIG. 4. Referring to FIG. 4, one field 1TV includes three subfields 1SF, 2SF, and 3SF, and signals for driving the red, green, and blue organic EL elements are applied to the subfields 1SF, 2SF, and 3SF, periods of which are the same.

In the subfield 1SF, when a low-level select signal is applied to the select scan line S1 on the first row, data voltages of R corresponding to red of the pixels on the first row are applied, respectively, to the data lines D1 to Dm, and a low-level emit signal is applied to the emit signal line E1*r* on the first row. The corresponding one of the data voltages of R is applied to the capacitor C1 through the switching transistor M2 of each pixel on the first row, and a voltage corresponding to the corresponding one of the data voltages of R is charged in the capacitor C1. The emitting transistor M3*r* of the pixel on the first row is turned on, and a current corresponding to a gate-source voltage stored in the capacitor C1 is transmitted to the red organic EL element OLEDr from the driving transistor M1 to thus emit light.

Next, when a low-level select signal is applied to the select scan line S2 on the second row, the data voltages of R corresponding to the red of pixels of the second row are applied, respectively, to the data lines D1 to Dm, a low-level emit signal is applied to the emit signal line E2*r* of the second row, and a current corresponding to the corresponding one of the data voltages of R provided by a corresponding one of the data lines D1 to Dm is supplied to the red organic EL element OLEDg of each pixel on the second row to thus emit light.

Then the data voltages are sequentially applied to pixels of from the third to (n-1)th rows to emit the red organic EL element OLEDr. When a low-level select signal is applied to the select scan line Sn on the nth row, the data voltages of R corresponding to the red of the pixels of the nth row are applied to the data lines D1 to Dm, and a low-level emit signal is applied to the emit signal line Enr of the nth row. A current corresponding to a corresponding one of the data voltages of R provided by the data lines D1 to Dm is accordingly supplied to the red organic EL element OLEDr of each pixel on the nth row to thus emit light.

As a result, the data voltages of R corresponding to red are applied to the respective pixels formed on the display panel 100 during the subfield 1SF. The emit signals applied to the emit signal lines E1*r* to Enr are maintained at the low level for a predetermined time, and the organic EL element OLEDr coupled to the emitting transistor M3*r* to which the corresponding emit signal is applied during the emit signal is at the low level consecutively emits light. This period is illustrated to correspond to the subfield 1SF in FIG. 4. That is, the red organic EL element OLEDr for each pixel emits light with brightness which corresponds to the data voltage applied during the period which corresponds to the subfield.

In the subfield 2SF, in a like manner as the subfield 1SF, a low-level select signal is sequentially applied to the select scan lines S1 to Sn of from the first to the nth rows, and when the select signal is applied to the respective select scan lines S1 to Sn, data voltages of G corresponding to green of pixels of the corresponding rows are applied, respectively, to the data lines D1 to Dm. A low-level emit signal is sequentially applied to the emit signal line E1*g* to Eng in synchronization with sequentially applying the low-level select signal to the select scan lines S1 to Sn. A current corresponding to the applied data voltage is transmitted to the green organic EL element OLEDg through the emitting transistor M3*g* in each pixel to emit light.

In the subfield 3SF, in a like manner as the subfield 2SF, a low-level select signal is sequentially applied to the select scan lines S1 to Sn of from the first to the nth rows, and when the select signal is applied to the respective select scan lines S1 to Sn, data voltages of B corresponding to blue of pixels of the corresponding rows are applied, respectively, to the data lines D1 to Dm. A low-level emit signal is sequentially applied to the emit signal lines E1*b* to Enb in synchronization with sequentially applying the low-level select signal to the select scan lines S1 to Sn. A current corresponding to the applied data voltage of B is transmitted to the blue organic EL element OLEDb through the emitting transistor M3*b* in each pixel to emit light.

As described above, one field is divided into three subfields, and the subfields are sequentially driven in the organic EL display driving method according to the first exemplary embodiment. One color organic EL element of one pixel in each subfield emits light, and the organic EL elements of three colors (red, green, and blue) sequentially emit light through three subfields to thus represent colors.

The signal timing diagram of FIG. 4 illustrates that the organic EL display is driven from the single scan method to the progressive scan method. In addition, the organic EL display can be driven using a dual scan method, an interlaced scan method, and other scan methods without being restricted to them.

Also, the red, green, and blue organic EL elements have been described to emit light during the same period according to the first exemplary embodiment, but the white balance can be incorrect because of different efficiency of the organic EL elements of respective colors when they emit light during the same period. In this case, the emit periods of the organic EL elements of respective colors are to be modified, which will be described with reference to FIG. 5.

Figure 5:
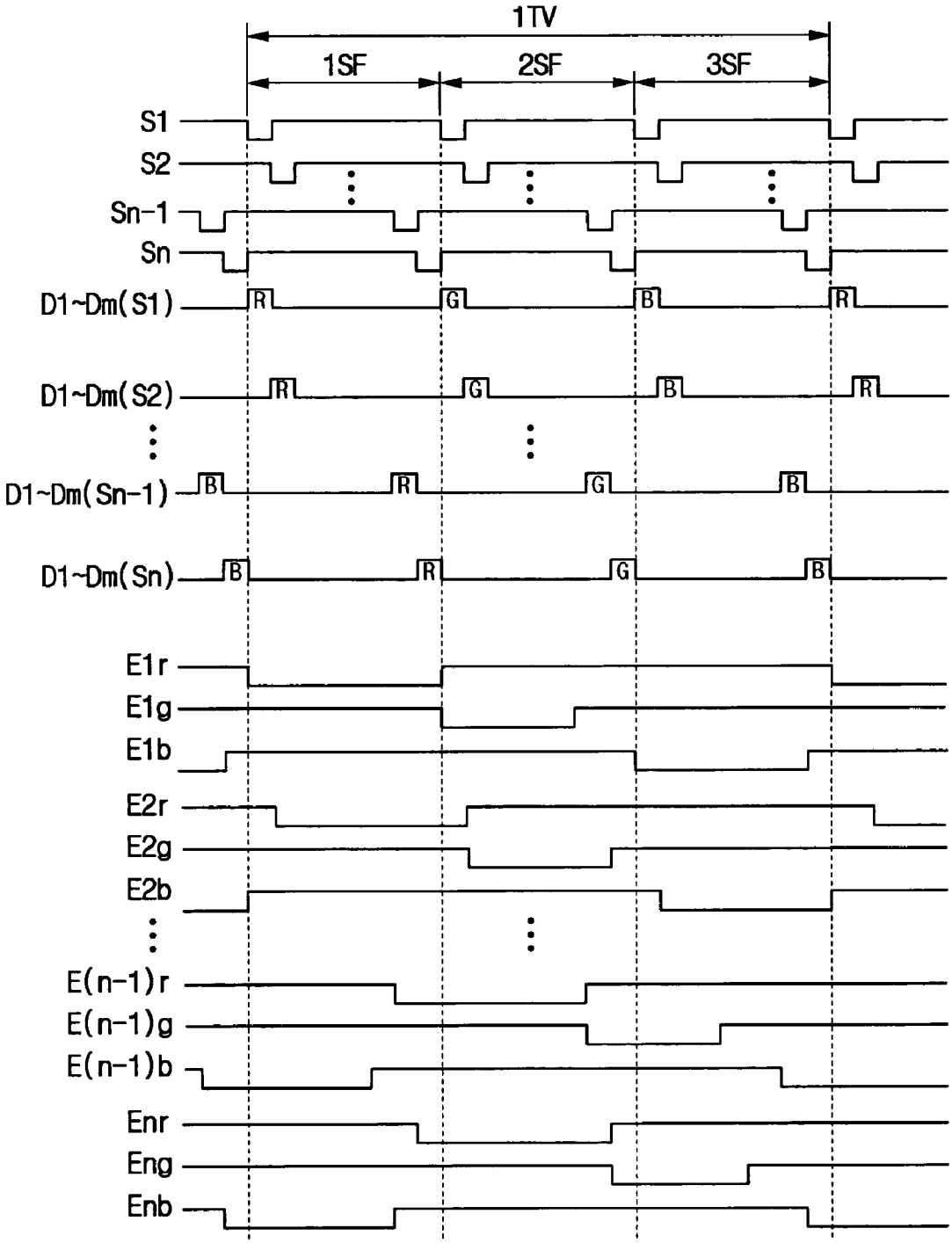
FIGS. 5 and 6 show signal timing diagrams of an organic EL display according to second and third exemplary embodiments of the present invention.

FIG. 5 shows a signal timing diagram of the organic EL display according to a second exemplary embodiment of the present invention.

As shown in FIG. 5 differing from FIG. 4, low-level periods of emit signals applied to the emit signal lines E1*r* to Enr corresponding to red, emit signals applied to the emit signal lines E1*g* to Eng corresponding to green, and emit signals applied to the emit signal lines E1*b* to Enb corresponding to blue are different from each other. As described above, the emit periods of the organic EL elements depend on low-level periods of the emit signals applied to the gates of the emitting transistors M3*r*, M3*g*, and M3*b* coupled to the corresponding organic EL elements, and hence, emit times of the respective organic EL elements can be varied by providing different low-level periods of emit signals.

For example in FIG. 5, low-level periods of emit signals applied to the emit signal lines E1*r* to Enr coupled to the gate of the transistor M3*r* coupled to the red organic EL element OLEDr are established to be the longest, and low-level periods of emit signals applied to the emit signal lines E1*b* to Enb coupled to the gate of the transistor M3*b* coupled to the blue organic EL element OLEDb are established to be the shortest. An emit time of the red organic EL element OLEDr is lengthened, and an emit time of the blue organic EL element OLEDb is shortened. The white balance is controlled well through the above-noted process when the emit efficiency of the red organic EL element OLEDr is the worst and the emit efficiency of the blue organic EL element OLEDb is the best.

The colors are controlled to emit light in the order of red, green, and blue in FIGS. 4 and 5, and they can emit light in other orders. Also, it is possible to divide a field into four subfields rather than three subfields and control the fourth subfield to drive an organic EL element of one color to emit light, or drive organic EL elements of two or more colors concurrently. Further, it is possible to add an organic EL element for displaying white in addition to the three organic EL elements, and either drive the white organic EL element during a subfield or drive four-color organic EL elements respectively during four subfields.

Figure 6:
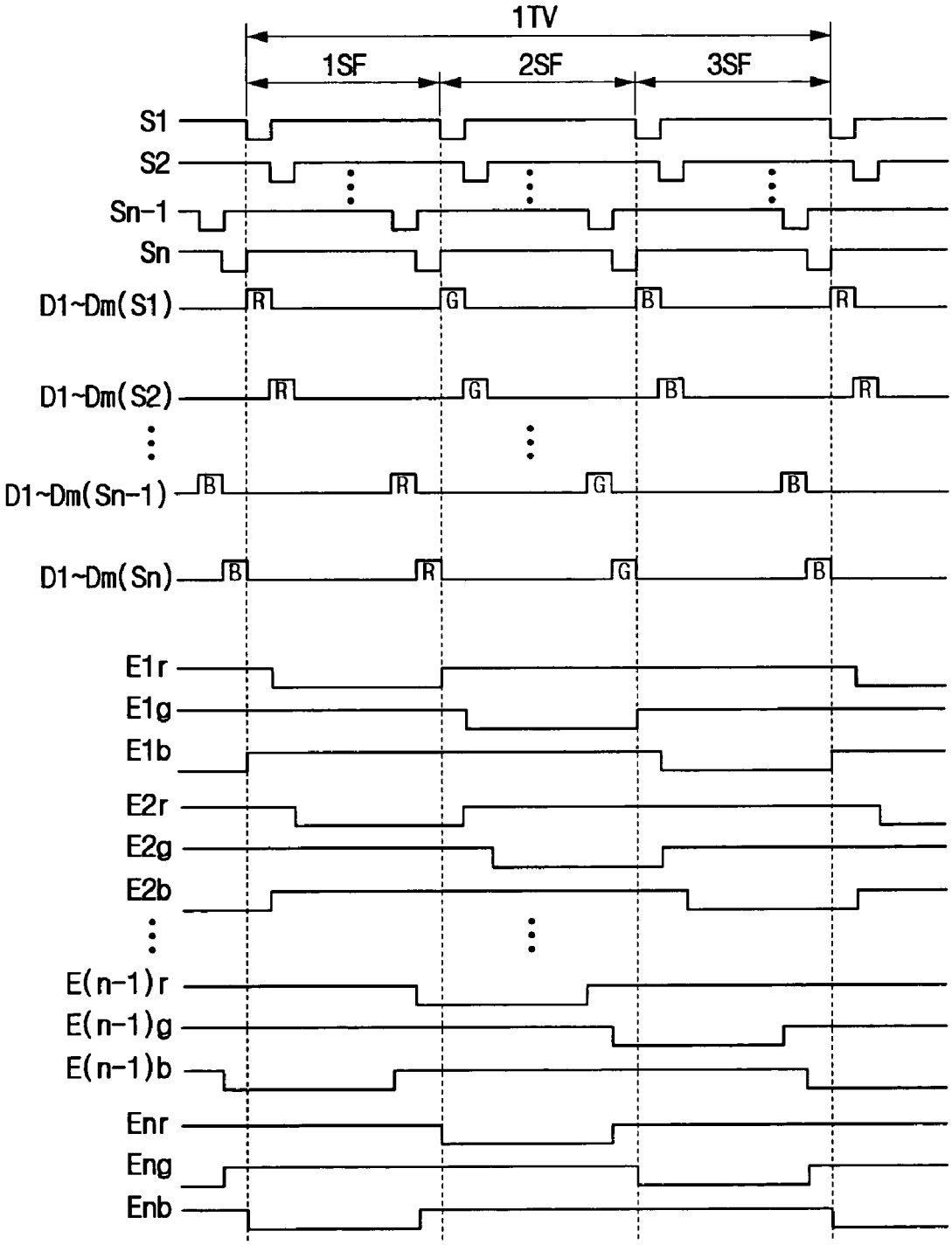

Also, referring to FIGS. 4 and 5, the select signal has been illustrated to be low-level and the emit signal has been illustrated to be concurrently low-level in one pixel. Alternatively, the emit signal can be low-level after the select signal is switched to high-level from low-level. That is, referring to FIG. 6, the select signal becomes high-level and the emit signal applied to the emit signal lines E1*r*, E1*g*, and E1*b* becomes low-level after the select signal applied to the select scan line S1 changes from low-level to high-level and a voltage which corresponds to the data voltage provided by the data lines D1 to Dm is programmed to the capacitor C1 of each pixel according to the third exemplary embodiment. As a result, the organic EL elements are prevented from emitting light while the data are programmed.

P-channel transistors have been applied to the pixels according to the first to third exemplary embodiments, and n-channel transistors, combinations of p-channel and n-channel transistors, and other switches having similar functions as the p-channel and n-channel transistors can also be used in addition to the p-channel transistors.

The emitting transistors M3*r*, M3*g*, and M3*b* have been driven by individual emit signal lines in the first to third exemplary embodiments. That is, three emit signal lines have been used for each pixel. Differing from this, all three of the pixels can be driven using only two emit signal lines, which will now be described with reference to FIGS. 7 and 8.

Figure 7:
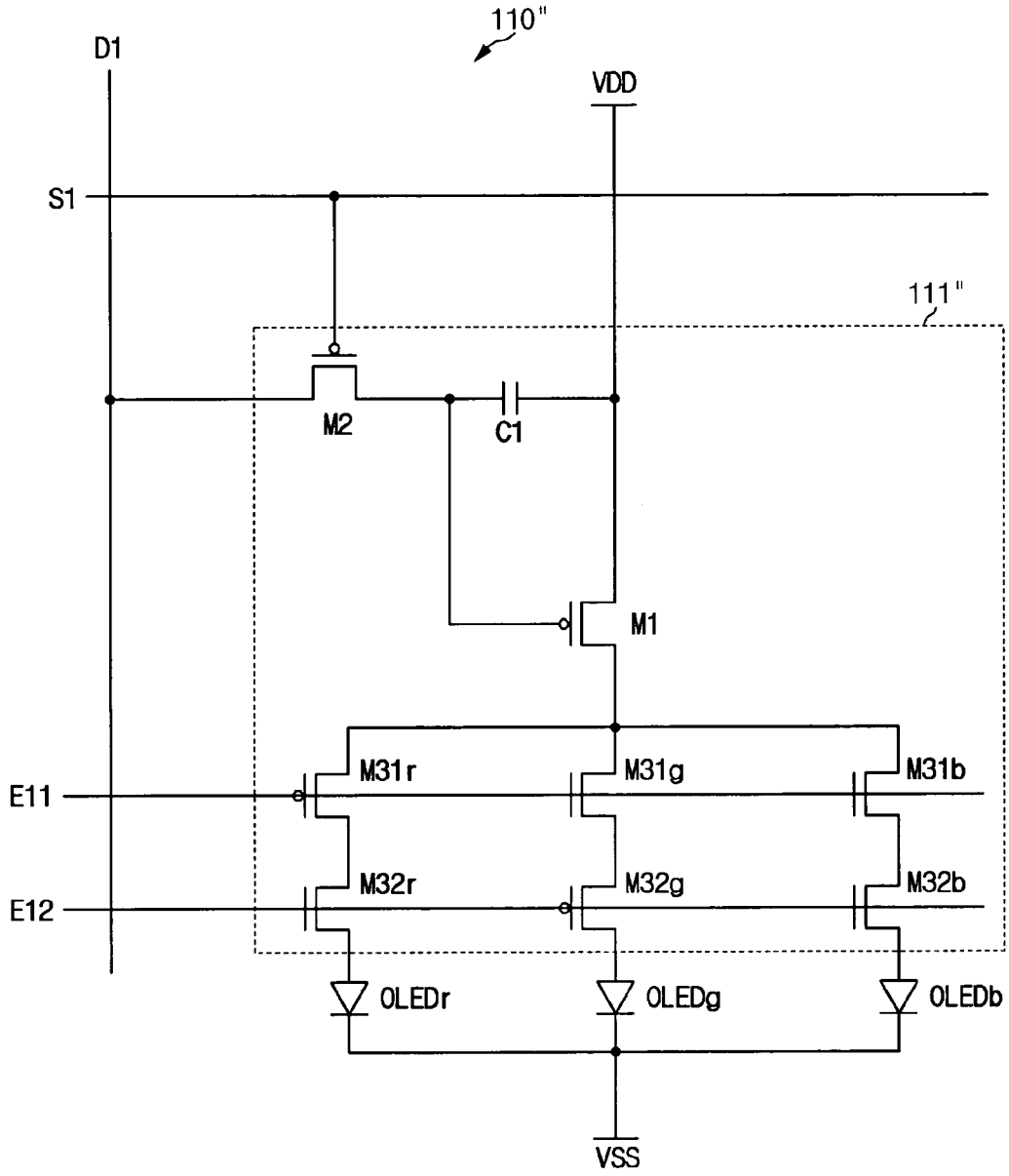
FIG. 7 shows a circuit diagram of a pixel in an organic EL display according to a fourth exemplary embodiment of the present invention.
Figure 8:
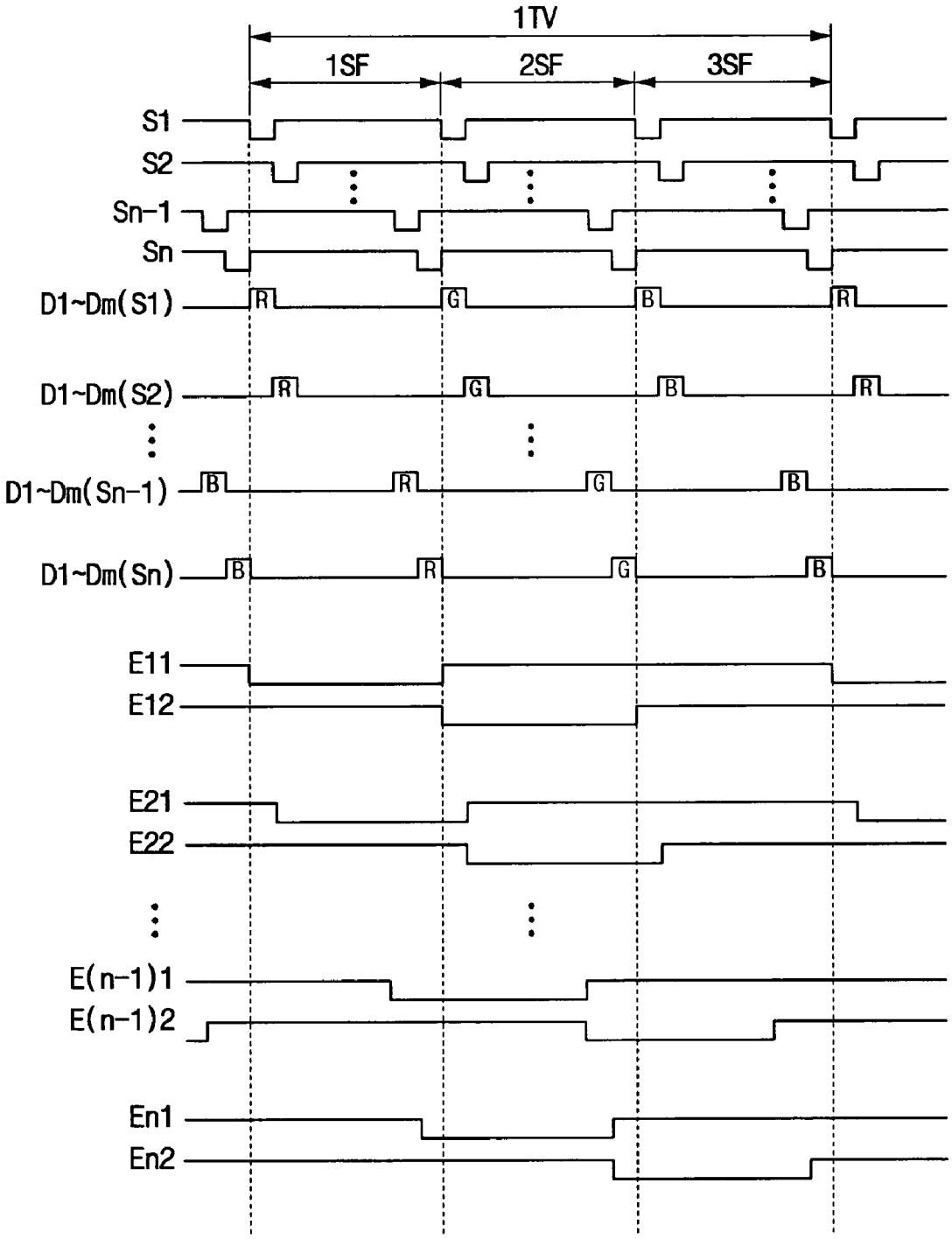
FIG. 8 shows a signal timing diagram of the organic EL display according to the fourth exemplary embodiment of the present invention.

FIG. 7 shows a circuit diagram of a pixel 110" in the organic EL display according to a fourth exemplary embodiment of the present invention, and FIG. 8 shows a signal timing diagram of the organic EL display according to the fourth exemplary embodiment of the present invention. In detail, FIG. 7 illustrates a voltage programming pixel 110" coupled to the select scan line S1 of the first row and the data line D1 of the first column. The pixel 110", for example, can be used as the pixel 110 of FIGS. 1 and 2.

Referring to FIG. 7, differing from the pixel circuit of FIG. 3, the pixel circuit according to the fourth exemplary embodiment has two emitting transistors for each color's organic EL element, and the emitting transistors are driven by two emit signal lines. An emit scan line E1 includes two emit signal lines E11 and E12, and other emit scan lines E2 to En have two emit signal lines E21 to En1 and E22 to En2, respectively.

In detail, a p-channel emitting transistor M31*r* and an n-channel emitting transistor M32*r* are coupled in series between a drain of the driving transistor M1 and a red organic EL element OLEDr, an n-channel emitting transistor M31*g* and a p-channel emitting transistor M32*g* are coupled in series between the drain of the driving transistor M1 and a green organic EL element OLEDg, and n-channel emitting transistors M31*b* and M32*b* are coupled in series between the drain of the driving transistor M1 and a blue organic EL element OLEDb. Gates of the emitting transistors M31*r*, M31*g*, and M31*b* are coupled in common to the emit signal line E11, and gates of the emitting transistors M32*r*, M32*g*, and M32*b* are coupled in common to the emit signal line E12.

Accordingly, the current is supplied to the red organic EL element OLEDr when an emit signal applied to the emit signal line E11 is low-level and an emit signal applied to the emit signal line E12 is high-level, the current is supplied to the green organic EL element OLEDg when an emit signal applied to the emit signal line E11 is high-level and an emit signal applied to the emit signal line E12 is low-level, and the current is supplied to the blue organic EL element OLEDb when both the emit signals applied to the emit signal lines E11 and E12 are high-level. That is, when the emit signals are supplied in the three subfields according to the above-described method, the red, green, and blue organic EL elements are sequentially driven with two emit signals according to the signal timing of FIG. 8.

An organic EL display driving method according to the fourth exemplary embodiment of the present invention will be described with reference to FIG. 8. One field (1TV) includes three subfields 1SF, 2SF, and 3SF, and signals for driving red, green, and blue organic EL elements of each pixel are applied to the subfields 1SF, 2SF, and 3SF in a like manner as FIG. 4.

Referring to FIG. 8, emit signals applied to the emit signal lines E11 to En1 have the same timing as that applied to the emit signal lines E1*r* to Enr of FIG. 4, and emit signals applied to the emit signal lines E12 to En2 have the same timing as that applied to the emit signal lines E1*g* to Eng of FIG. 4.

In the subfield 1SF, since the emit signal applied to the emit signal line E11 is low-level and the emit signal applied to the emit signal line E12 is high-level, the emitting transistors M31*r* and M32*r* are turned on, and hence, the current is supplied to the red organic EL element OLEDr to emit light. However, no current is supplied to the green and blue organic EL elements OLEDg and OLEDb since the n-channel transistors M31*g* and M31*b* coupled to the emit signal line E11 are turned off.

In the subfield 2SF, since the emit signal applied to the emit signal line E11 is high-level and the emit signal applied to the emit signal line E12 is low-level, the emitting transistors M31*g* and M32*g* are turned on, and hence, the current is supplied to the green organic EL element OLEDg to emit light. However, no current is supplied to the red and blue organic EL elements OLEDr and OLEDb since the n-channel transistors M32*r* and M32*b* coupled to the emit signal line E12 are turned off.

In the subfield 3SF, since the emit signals applied to the emit signal lines E11 and E12 are high-level, the emitting transistors M31*b* and M32*b* are turned on, and hence, the current is supplied to the blue organic EL element OLEDb to emit light. However, no current is supplied to the red and green organic EL elements OLEDr and OLEDg since the p-channel transistors M31*r* and M32*g* respectively coupled to the emit signal lines E11 and E12 are turned off.

Therefore, the three-colored organic EL elements are controlled by using two emit signal lines in the fourth exemplary embodiment. The transistors M31*r* and M32*g* are p-channel transistors and the transistors M32*r*, M31*g*, M31*b*, and M32*b* are n-channel transistors in FIGS. 7 and 8. In other embodiments, conductivity types of these transistors can be combined in different manners when the transistors are controllable in a manner similar to that illustrated by the timing diagram of FIG. 8. Also, the timing diagrams similar to those of second and third exemplary embodiments in FIGS. 5 and 6 can be used with the pixel circuit 110" of FIG. 7 according to the fourth exemplary embodiment.

The voltage programming pixel circuit using switching transistors and driving transistors has been described in the first to fourth exemplary embodiments, and a voltage programming pixel circuit using transistors for compensating for threshold voltages of the driving transistors or transistors for compensating for voltage dropping as well as the switching transistors and driving transistors is applicable. Also, the present invention is applicable to current programming pixel circuits when the driving waveform described with reference to FIG. 5, that is, the driving waveform in which the emit signal is high-level while the select signal is low-level.

The organic EL elements sequentially emit light of one color in one subfield, and other organic EL elements sequentially emit light of other colors in the next subfield in the first to fourth exemplary embodiments. The color emitted at upper rows of the display panel is different from the color emitted at lower rows thereof at an instance during the above-noted driving. Referring to FIG. 4, the red organic EL elements emit light in the upper region of the display area and the blue organic EL elements emit light in the lower region of the display area in the temporally middle part of one subfield 1SF. When the organic EL display is shaken in this instance, red areas and blue areas may look separated, which is generally referred to as a color separation phenomenon.

An exemplary embodiment for eliminating or reducing the color separation phenomenon will now be described with reference to FIG. 9.

Figure 9:
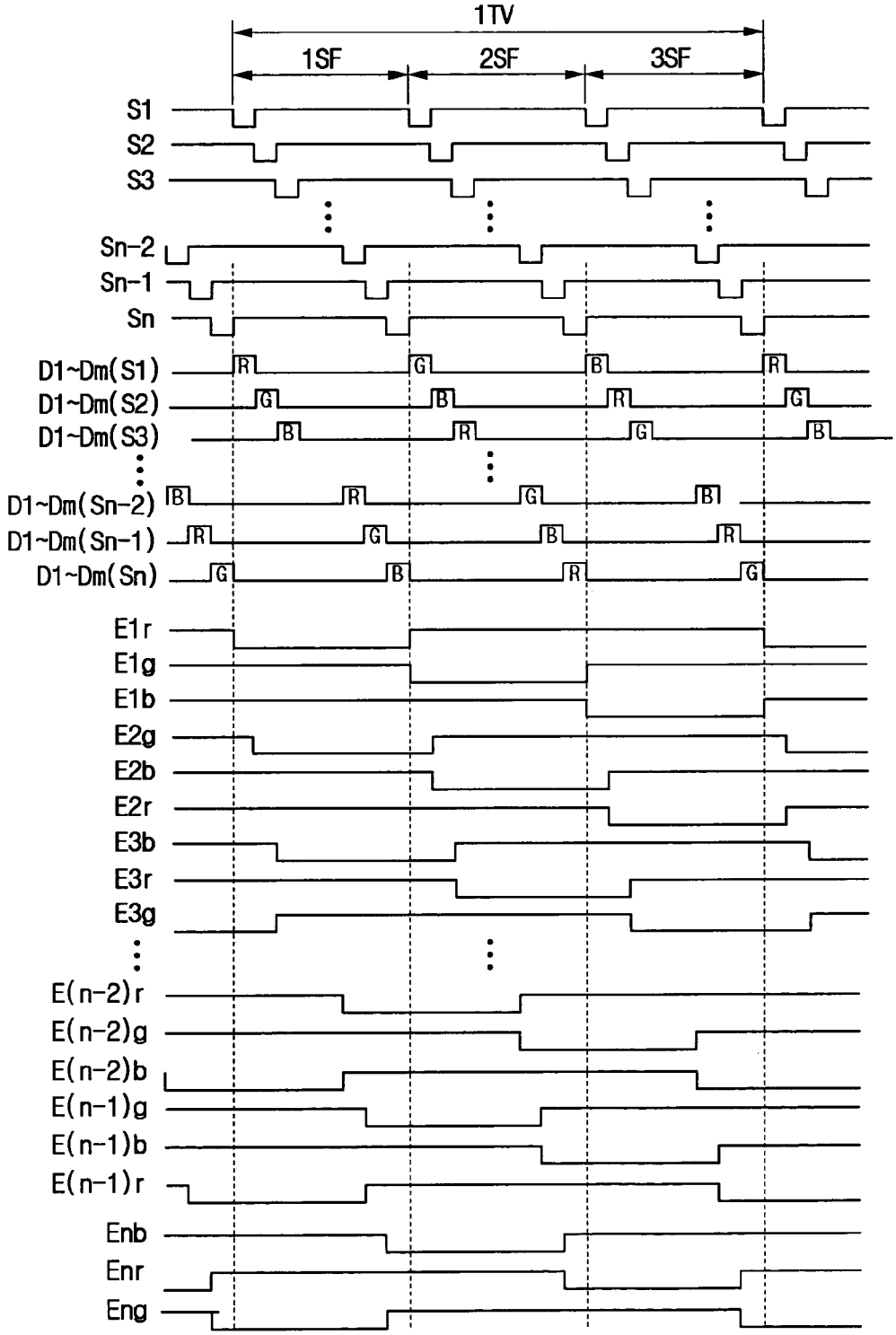
FIG. 9 shows a signal timing diagram of an organic EL display according to a fifth exemplary embodiment of the present invention.

FIG. 9 shows a signal timing diagram of the organic EL display according to a fifth exemplary embodiment of the present invention.

Referring to FIGS. 3 and 9, in the subfield 1SF, when a select signal is applied to the scan line S1 of the first row, data voltages of R corresponding to red of the pixels of the first row are applied, respectively, to the data lines D1 to Dm, and an emit signal for turning on the emitting transistor M3*r* coupled to the red organic EL element OLEDr is applied to the emit signal line E1*r* so that the red organic EL element OLEDr emits light at each pixel on the first row.

A select signal is applied to the scan line S2 of the second row and data voltages of G corresponding to green of the pixels of the second row are applied, respectively, to the data lines D1 to Dm, and an emit signal for turning on the emitting transistor M3*g* coupled to the green organic EL element OLEDg is applied to the emit signal line E2*g* so that the green organic EL element OLEDg emits light at each pixel on the second row.

A select signal is applied to the scan line S3 of the third row and data voltages of B corresponding to blue of the pixels of the third row are applied, respectively, to the data lines D1 to Dm, and an emit signal for turning on the emitting transistor M3*b* coupled to the blue organic EL element OLEDb is applied to the emit signal line E3*b* so that the blue organic EL element OLEDb emits light at each pixel on the third row.

Therefore, in the first subfield 1SF, the red organic EL elements OLEDr start emitting light in the pixel circuits coupled to scan lines (S4, S7, . . . , S(n-2)) of every third row after the first row where 'n' is assumed to be an integer which is a multiple of 3, the green organic EL elements OLEDg start emitting light in the pixel circuits coupled to scan lines (S5, S8, . . . , S(n-1)) of every third row after the second row, and the blue organic EL elements OLEDb start emitting light in the pixel circuits coupled to scan lines (S6, S9, . . . , Sn) of every third row after the third row.

In the subsequent subfield 2SF, when a select signal is applied to the scan line S1 of the first row, data voltages of G corresponding to green of the pixels of the first row are applied, respectively, to the data lines D1 to Dm, and an emit signal for turning on the emitting transistor M3*g* coupled to the green organic EL element OLEDg is applied to the emit signal line E1*g* so that the green organic EL element OLEDg emits light at each pixel on the first row.

A select signal is applied to the scan line S2 of the second row and data voltages of B corresponding to blue of the pixels of the second row are applied, respectively, to the data lines D1 to Dm, and an emit signal for turning on the emitting transistor M3*b* coupled to the blue organic EL element OLEDb is applied to the emit signal line E2*b* so that the blue organic EL element OLEDb emits light at each pixel on the second row.

A select signal is applied to the scan line S3 of the third row and data voltages of R corresponding to red of the pixels of the third row are applied, respectively, to the data lines D1 to Dm, and an emit signal for turning on the emitting transistor M3*r* coupled to the red organic EL element OLEDr is applied to the emit signal line E3*r* so that the red organic EL element OLEDr emits light at each pixel on the third row.

Therefore, in the second subfield 2SF, the green organic EL elements OLEDg start emitting light in the pixel circuits coupled to scan lines (S4, S7, . . . , S(n-2)) of every third row after the first row, the blue organic EL elements OLEDb start emitting light in the pixel circuits coupled to scan lines (S5, S8, . . . , S(n-1)) of every third row after the second row, and the red organic EL elements OLEDr start emitting light in the pixel circuits coupled to scan lines (S6, S9, . . . , Sn) of every third row after the third row.

In the subsequent subfield 3SF, when a select signal is applied to the scan line S1 of the first row, data voltages of B corresponding to blue of the pixels of the first row are applied, respectively, to the data lines D1 to Dm, and an emit signal for turning on the emitting transistor M3*b* coupled to the blue organic EL element OLEDb is applied to the emit signal line E1*b* so that the blue organic EL element OLEDb emits light at each pixel on the first row.

A select signal is applied to the scan line S2 of the second row and data voltages of R corresponding to red of the pixels of the second row are applied, respectively, to the data lines D1 to Dm, and an emit signal for turning on the emitting transistor M3*r* coupled to the red organic EL element OLEDr is applied to the emit signal line E2*r* so that the red organic EL element OLEDr emits light at each pixel on the second row.

A select signal is applied to the scan line S3 of the third row and data voltages of G corresponding to green of the pixels of the third row are applied, respectively, to the data lines D1 to Dm, and an emit signal for turning on the emitting transistor M3*g* coupled to the green organic EL element OLEDg is applied to the emit signal line E3*g* so that the green organic EL element OLEDg emits light at each pixel on the third row.

Therefore, in the third subfield 3SF, the blue organic EL elements OLEDb start emitting light in the pixel circuits coupled to scan lines (S4, S7, . . . , S(n-2)) of every third row after the first row, the red organic EL elements OLEDr start emitting light in the pixel circuits coupled to scan lines (S5, S8, . . . , S(n-1)) of every third row after the second row, and the green organic EL elements OLEDg start emitting light in the pixel circuits coupled to scan lines (S6, S9, . . . , Sn) of every third row after the third row.

Hence, the color separation phenomenon which may be generated because of different colors in the upper region and the lower region on a screen is reduced or eliminated by combining colors for each row and emitting them rather than programming data signal which corresponds to one color and controlling the corresponding color's emitting elements in a subfield according to the fifth exemplary embodiment.

Each row emits a different color in the fifth exemplary embodiment, and without being restricted to this, it is possible to combine a plurality of rows into a group, and allow each group to emit a different color. Also, while the emit elements with three colors have been described in reference to the exemplary embodiments, the present invention is applicable to emit elements with two or more than three colors, which will not be described since a person skilled in the art would know how to modify the embodiments described herein to practice such other embodiments.

Since the emit elements with various colors can be driven with common driving and switching transistors and capacitors for each pixel according to the exemplary embodiments of the present invention, a configuration of elements used in the pixel and a wiring design for transmitting the current, voltage, and signals are simplified, and accordingly, the aperture ratio in the pixel is improved, and the color separation phenomenon is reduced or eliminated by emitting different colors for each row in a single subfield.

While this invention has been described in connection with certain exemplary embodiments, it is to be understood that the invention is not limited to the disclosed embodiments, but, on the contrary, is intended to cover various modifications and equivalent arrangements included within the spirit and scope of the appended claims.

What is claimed is:

1. A display device comprising:

a plurality of rows of pixels for displaying an image during a field having a plurality of subfields, each of the pixels comprising a plurality of light emitting elements having different colors;

a plurality of data lines for applying data signals to the pixels for the light emitting elements to emit light;

a plurality of select lines coupled to the pixels for applying a plurality of select signals, each of the select lines being coupled to a corresponding one of the rows of pixels to apply a corresponding one of the select signals thereto;

a scan driver configured to provide the plurality of select signals sequentially on all of the select lines to sequentially select all of the rows of pixels during each of the plurality of subfields;

a plurality of emit lines coupled to each of the plurality of rows of pixels for applying emit signals to the pixels, the plurality of emit lines configured to sequentially start applying the emit signals at substantially a same time as the select signals for the corresponding one of the rows of pixels start being provided in accordance with the plurality of subfields; and a data driver configured to apply the data signals to the pixels for the light emitting elements having different colors to sequentially start emitting different color lights during each of the plurality of subfields, such that each of the light emitting elements continuously emits light during a period having a total duration less than or equal to the duration of one of the plurality of subfields of the field, wherein a first color sequence of the different colors corresponding to the data signals applied to all of the rows of pixels from first through last rows in accordance with the sequential selection of all of the select lines in a first subfield of the plurality of subfields is different from a second color sequence of the different colors corresponding to the data signals applied to all of the rows of pixels from the first through last rows in accordance with the sequential selection of all of the select lines in a second subfield of the plurality of subfields, such that the first color sequence in which the light emitting elements having different colors start emitting light in all of the plurality of rows from the first through last rows in the first subfield is different from the second color sequence in which the light emitting elements having different colors start emitting light in all of the plurality of rows from the first through last rows.

2. The display device of claim 1, wherein each of the light emitting elements emits red, green or blue light, and wherein each of the red, green and blue lights is emitted on every third one of the rows of pixels during each of the plurality of subfields.

3. The display device of claim 1, wherein white balance of the image is controlled by utilizing the emit signals to make the duration of the emit periods of different colored light emitting elements different.

4. The display device of claim 1, wherein a number of the emit lines coupled to each of the rows of pixels is the same as a number of the light emitting elements in each of the pixels.

5. The display device of claim 1, wherein a number of the emit lines coupled to each of the rows of pixels is less than a number of the light emitting elements in each of the pixels by at least one.

6. A display device comprising a plurality of scan lines for providing a plurality of scan signals, the plurality of scan lines including a first scan line for applying a first signal among the scan signals and a second scan line for applying a second signal among the scan signals at a time different from that of applying the first signal, a plurality of data lines for applying data signals for displaying an image during a field having a plurality of subfields, a plurality of pixel circuits arranged as rows of the pixel circuits and including a first pixel circuit coupled to the first scan line and one of the data lines and a second pixel circuit coupled to the second scan line and the one of the data lines, a data driver configured to provide the data signals to the plurality of data lines, a scan driver configured to sequentially provide the scan signals on all of the scan lines to apply a corresponding one of the data signals to each of the pixel circuits at least once for each of the subfields, such that a first color sequence of different colors corresponding to the data signals applied to all of the rows of the pixel circuits from first through last rows in accordance with the sequentially provided scan signals in a first subfield of the plurality of subfields is different from a second color sequence of the different colors corresponding to the data signals applied to all of the rows of the pixel circuits from the first through last rows in accordance with the sequentially provided scan signals in a second subfield of the plurality of subfields, and a plurality of emit lines for transmitting emit signals to the plurality of pixel circuits, the plurality of emit lines including at least two emit lines for each of the first pixel circuit and the second pixel circuit, the at least two emit lines for a corresponding one of the pixel circuits being configured to sequentially start transmission of the emit signals at substantially a same time as the scan signals for the corresponding one of the pixel circuits start being provided in accordance with the plurality of subfields;

wherein each of the pixel circuits comprises:

at least two emit elements for emitting light having different colors, wherein each of the emit elements emits light responsive to an applied current;

a switching transistor for applying the corresponding one of the data signals in response to the first signal or the second signal;

a capacitor for storing a voltage which corresponds to the corresponding one of the data signals applied by the switching transistor; and a driving transistor for outputting the applied current which corresponds to the voltage stored in the capacitor, wherein one of the emit elements having a color different from a first color starts emitting light in the second pixel circuit after one of the emit elements having the first color starts emitting light in the first pixel circuit in the first subfield, and one of the emit elements having a color different from a second color starts emitting light in the second pixel circuit after one of the emit elements having the second color starts emitting light in the first pixel circuit in second subfield, and so that each of the emit elements continuously emits light during a period having a total duration less than or equal to the duration of one of the plurality of subfields of the field.

7. The display device of claim 6, wherein each of the pixel circuits further comprises at least two emitting transistors coupled between the driving transistor and the at least two emit elements, and one of the emit elements having one color from among the two emit elements emits light according to an operation of the emitting transistors.

8. The display device of claim 7, wherein the at least two emit lines are respectively coupled to gates of the emitting transistors and apply emit signals for controlling operations of the emitting transistors, wherein one of the emitting transistors is turned on by one of the emit signals applied through the emit lines, and the applied current is applied to one of the emit elements from the driving transistor.

9. The display device of claim 6, wherein the first scan line is near the second scan line.

10. The display device of claim 6, wherein the emit elements include an emit element of the first color, an emit element of the second color, and an emit element of a third color, and each of the pixel circuits further comprises a first emitting transistor coupled between the driving transistor and the emit element of the first color, a second emitting transistor coupled between the driving transistor and the emit element of the second color, and a third emitting transistor coupled between the driving transistor and the emit element of the third color.

11. The display device of claim 10, wherein the emit element of the second color of the second pixel circuit starts emitting light in the first subfield, and the emit element of the third color of the second pixel circuit starts emitting light in the second subfield.

12. The display device of claim 11, wherein the emit element of the first color of the second pixel circuit starts emitting light in a third subfield of the plurality of subfields, and the emit element of the third color of the first pixel circuit starts emitting light in the third subfield.

13. The display device of claim 12, wherein a third scan line among the scan lines applies a third signal among the scan signals at a timing which is different from timing of applying the first and second signals, wherein a third pixel circuit among the plurality of pixel circuits that has an emit element of the first color, an emit element of the second color and an emit element of the third color is coupled to the third scan line and one of the data lines; and the emit elements of the third color, the first color, and the second color of the third pixel circuit start emitting light in the first subfield, the second subfield, and the third subfield, respectively.

14. The display device of claim 10, wherein a first emit line of the at least two emit lines is for applying a first emit signal for controlling an operation of the first emitting transistor, a second emit line of the at least two emit lines is for applying a second emit signal for controlling an operation of the second emitting transistor, and a third emit line of the at least two emit lines is for applying a third emit signal for controlling an operation of the third emitting transistor, wherein one of the first, second and third emitting transistors is turned on responsive to one of the first, second and third emit signals, and the applied current is applied to one of the emit elements of the first, second and third colors from the driving transistor.

15. The display device of claim 6, wherein one of the emit elements emits light for a period which is shorter than or equal to a period which corresponds to a corresponding one of the subfields after the one of the emit elements starts emitting light.

16. The display device of claim 6, wherein the emit elements emit light at least once during one field.

17. The display device of claim 16, wherein the emit elements of the same color emit light during a predetermined period in a plurality of pixel circuits coupled to the same one of the scan lines.

18. A display device including a plurality of scan lines for applying select signals, a plurality of data lines for applying data signals for displaying an image during a field having a plurality of subfields, a plurality of pixel circuits arranged as rows of the pixel circuits and coupled to the scan lines and the data lines, a data driver configured to provide the data signals to the plurality of data lines, a scan driver configured to provide the select signals sequentially on all of the plurality of scan lines to apply a corresponding one of the data signals to each of the pixel circuits at least once for each of the subfields, such that a first color sequence of different colors corresponding to the data signals applied to all of the rows of the pixel circuits from first through last rows in accordance with the sequentially provided scan signals in a first subfield of the plurality of subfields is different from a second color sequence of the different colors corresponding to the data signals applied to all of the rows of the pixel circuits from the first through last rows in accordance with the sequentially provided scan signals in a second subfield of the plurality of subfields, and a plurality of emit lines for transmitting emit signals to the plurality of pixel circuits, the plurality of emit lines including at least two emit lines for each of the plurality of pixel circuits, the at least two emit lines for a corresponding one of the pixel circuits configured to sequentially start transmission of the emit signals at substantially a same time as the select signals for the corresponding one of the pixel circuits start being provided in accordance with the plurality of subfields;

wherein each of the pixel circuits comprises:

at least two emit elements for emitting light having different colors, wherein each of the emit elements emits light responsive to an applied current;

a switching transistor for applying one of the data signals which corresponds to one of the emit elements in response to one of the select signals;

a capacitor for storing a voltage which corresponds to the one of the data signals applied by the switching transistor;

a driving transistor for outputting the applied current which corresponds to the voltage stored in the capacitor; and a switch for selectively outputting the applied current provided by the driving transistor to one of the emit elements of a color corresponding to the one of the data signals;

wherein one of the data signals corresponding to one of the emit elements of a first color is applied to one of the data lines when one of the select signals is applied to a scan line of a first group including at least one of the scan lines, and one of the data signals corresponding to one of the emit elements of a second color is applied to the one of the data lines when one of the select signals is applied to a scan line of a second group including at least one of the scan lines in a first one of the subfields, such that each of the emit elements continuously emits light during a period having a total duration less than or equal to the duration of one of the plurality of subfields of the field.

19. The display device of claim 18, wherein the switch of one of the pixel circuits coupled to the scan line of the first group applies the applied current provided by the driving transistor to the one of the emit elements of the first color for a predetermined time, and the switch of the pixel circuit coupled to the scan line of the second group applies the applied current provided by the driving transistor to the one of the emit elements of the second color for the predetermined time.

20. The display device of claim 18, wherein one of the data signals corresponding to one of the emit elements of a color which is different from the first color is applied to the data line when the one of the select signals is applied to a scan line of the first group, and one of the data signals corresponding to one of the emit elements of a color which is different from the second color is applied to the one of the data lines when the one of the select signals is applied to a scan line of the second group in a second one of the subfields.

21. The display device of claim 18, wherein the emit elements emit light at least once during one field.

22. A method of driving a display device including a plurality of pixel circuits arranged in rows, wherein each of the pixel circuits comprises at least two emit elements for emitting light of different colors responsive to an applied current, and a transistor coupled to the emit elements supplies the applied current to one of the emit elements through at least one switch, the method for driving during a field having a plurality of subfields and comprising:

start emitting one of the emit elements of a first color in one of the pixel circuits provided on a row of a first group including at least one of the rows during a first subfield of the subfields; and start emitting one of the emit elements of a second color in one of the pixel circuits provided on a row of a second group including at least one of the rows during the first subfield, wherein each of the rows of the pixel circuits is selected for emission of at least one of the emit elements thereon by sequentially selecting all of select lines coupled to the rows of the pixel circuits and sequentially applying at least two different emit signals to each of the pixel circuits at substantially a same time as corresponding ones of the select lines are selected in accordance with the plurality of subfields, wherein each of the emit elements continuously emits light during a period having a total duration less than or equal to the duration of one of the plurality of subfields of the field, wherein a first color sequence of the different colors corresponding to data signals applied to all of the rows of pixels from first through last rows in accordance with the sequential selection of all of the select lines in the first subfield is different from a second color sequence of the different colors corresponding to the data signals applied to all of the rows of pixels from the first through last rows in accordance with the sequential selection of all of the select lines in a second subfield of the plurality of subfields, such that the first color sequence in which the light emitting elements having different colors start emitting light in all of the plurality of rows from the first through last rows in the first subfield is different from the second color sequence in which the light emitting elements having different colors start emitting light in all of the plurality of rows from the first through last rows.

23. The method of claim 22, further comprising:

start emitting one of the emit elements of a color different from the first color in one of the pixel circuits provided on a row of the first group during the second subfield; and start emitting one of the emit elements of a color different from the second color in one of the pixel circuits provided on a row of the second group during the second the second subfield.

24. The method of claim 23, further comprising:

start emitting one of the emit elements of a third color in one of the pixel circuits provided on a row of a third group including at least one of the rows during the first subfield; and start emitting one of the emit elements of a color different from the third color in one of the pixel circuits provided on a row of the third group during the second subfield.

25. The method of claim 24, comprising:

start emitting one of the emit elements of the third color in one of the pixel circuits provided on a row of the first group during a third subfield of the subfields;

start emitting one of the emit elements of the first color in one of the pixel circuits provided on a row of the second group during the third subfield; and start emitting one of the emit elements of the second color in one of the pixel circuits provided on a row of the third group during the third subfield.

* * * * *

UNITED STATES PATENT AND TRADEMARK OFFICE

CERTIFICATE OF CORRECTION

PATENT NO. : 7,804,466 B2
APPLICATION NO. : 11/055400
DATED : September 28, 2010
INVENTOR(S) : Won-Kyu Kwak et al.

It is certified that error appears in the above-identified patent and that said Letters Patent is hereby corrected as shown below:

| | |
|---|---|
| Column 14, Claim 6, line 52 | Before "second"<br>Insert -- the -- |
| Column 18, Claim 23, line 20 | After "during"<br>Delete "the second" |

Signed and Sealed this
Third Day of April, 2012

David J. Kappos

David J. Kappos
*Director of the United States Patent and Trademark Office*